US006815009B1

(12) United States Patent
White

(10) Patent No.: US 6,815,009 B1
(45) Date of Patent: Nov. 9, 2004

(54) AUTOMOTIVE PAINT SCRATCH REPAIR PROCESS

(75) Inventor: Charles R. White, Colleyville, TX (US)

(73) Assignee: Magic Auto Touch Up, Inc., Colleyville, TX (US)

( * ) Notice: Subject to any disclaimer, the term of this patent is extended or adjusted under 35 U.S.C. 154(b) by 116 days.

(21) Appl. No.: 10/313,417

(22) Filed: Dec. 6, 2002

(51) Int. Cl.[7] ..... B05D 3/12
(52) U.S. Cl. ..... 427/369
(58) Field of Search ..... 427/369

(56) References Cited

U.S. PATENT DOCUMENTS 4,814,200 A * 3/1989 Propst ..... 427/142
5,730,644 A * 3/1998 Pfanstiehl ..... 451/28
6,142,868 A * 11/2000 Pfanstiehl ..... 451/28

FOREIGN PATENT DOCUMENTS

CN 1206631 * 2/1999
CN 1232064 * 10/1999
CN 1324700 * 12/2001
JP 02-084484 * 3/1990
JP 08-071492 * 3/1996
WO WO 92/01519 * 2/1992
WO WO 02/74452 * 9/2002

OTHER PUBLICATIONS

Hamada, Jidosha Gijutsu, 57(5), pp 93098, 2003.*

* cited by examiner

*Primary Examiner*—Erma Cameron
(74) *Attorney, Agent, or Firm*—Mark W. Handley; Chauza & Handley, L.L.P.

(57) ABSTRACT

A paint repair process is provided for repairing scratches (12) and chips (22) in automotive paint (14). A paint mixture (26) is applied to the surface (24) of the automotive paint (14) and worked into the scratches (12) and the chips (22) by applying a minimum pressure of approximately one and one-quarter pounds per square inch directly to the paint mixture (26). After an initial drying of the paint mixture (26), the paint mixture (26) is polished and heated by applying a polishing mixture (28) to the surface of the paint mixture (26), and then pressing a natural wool fiber polishing pad against the surface of the paint mixture (26) with a minimum pressure of two pounds per square inch and moving the polishing pad relative to the outer surface of the paint mixture (26) at speeds in a rage of approximately 800 to 1050 feet per minute.

22 Claims, 2 Drawing Sheets

AUTOMOTIVE PAINT SCRATCH REPAIR PROCESS

TECHNICAL FIELD OF THE INVENTION

The present invention relates in general to paint processes, and in particular to a process for touching up scratches and chips in automotive paints.

BACKGROUND OF THE INVENTION

Prior art paint processes have been provided for touching up automotive paints. Typically, automotive touch up paints have been brushed or sprayed onto the surfaces of scratched or chipped automotive paints. However, brushing and spraying automotive touch up paints onto scratched and chipped paint surfaces does not exert sufficient pressure on the uncured touch up paints to overcome the surface tension of the liquid uncured touch up paints to move the touch up paints sufficiently into the scratches and small chips in the paint surfaces being repaired. Later polishing of the painted surface being touched up often results in removal of any touch up paint covering the scratch or chip, such that the scratch or chip remains visible. Similar touch up paint repair process have involved dabbing excessive amounts of touch up paint onto scratches and chips with brush applicators. This leaves a streak of paint which is usually not of a close color match, texture match or gloss match with the original automotive paint being touched up. Matching the gloss of modern clear coat automotive paint systems has proven difficult with conventional touch up paint systems. Typically, prior art repairs of scratches and chips in modern clear coat paints require that entire body panels of automobiles be repainted to touch up the automobiles.

SUMMARY OF THE INVENTION

An automotive paint repair process is disclosed for touch up of void spaces in automotive paints, such as for repairing scratches and chips in automobile paints. The painted surface to be touched up is first cleaned. A paint mixture is provided by mixing a base coat paint, a paint clear coat and a paint flow additive together. The paint mixture is applied to the surface of the paint being repaired, and the paint mixture is worked into void spaces in the paint. The paint mixture is worked into the void spaces, such as cracks and chips, by applying a minimum pressure of approximately one and one-quarter pounds per square inch directly to the paint mixture when the paint mixture is disposed on the surface of the paint, which forces the paint mixture into the void spaces. After an initial drying of the paint mixture, a polishing mixture is applied to the surface of the paint mixture and then the surface of the paint mixture is polished and heated using a natural wool fiber polishing pad. The polishing pad is pressed against the surface of the paint mixture with a minimum pressure of two pounds per square inch, with the polishing mixture disposed between the polishing pad and the surface of the paint mixture, and the polishing pad is moved relative to the painted surface at speeds in a range of approximately 800 feet per minute to approximately 1050 feet per minute. Preferably, the pressure applied in working the paint into the void space in the paint ranges from two and one-half to three pounds per square inch, and the polishing pad is pressed against the surface of the paint mixture with a pressure of approximately six pounds per square inch. The polishing pad is preferably provided by a rotary polishing pad having a pile of natural wool fibers. The pile has yarn strands with first diameters of approximately one-eight inch, lengths of approximately one and one-half inches, and a density of approximately one hundred and twenty eight yarn strands per inch.

DESCRIPTION OF THE DRAWINGS

For a more complete understanding of the present invention and the advantages thereof, reference is now made to the following description taken in conjunction with the accompanying Drawings in which

FIG. 1 is a sectional view of a first painted surface, showing a paint scratch formed into the first painted surface;

FIG. 2 is a sectional view of a second painted surface, showing a chip formed in the second painted surface;

FIG. 3 is a sectional view of the first painted surface, after a touch up paint mixture has been applied to the first painted surface and worked into the paint scratch;

FIG. 4 is a sectional view of the second painted surface, after the touch up paint mixture has been applied to the second painted surface and worked into the chip in the paint;

FIG. 5 is top view of the first painted surface after the touch up paint mixture has been applied and initially cured, and then a polish has been applied to the first painted surface;

FIG. 6 is top view of the second painted surface after the touch up paint mixture has been applied and initially cured, and then a polish has been applied to the second painted surface;

FIG. 7 is a sectional view of the first painted surface after the touch up paint mixture has been polished and heated cured;

FIG. 8 is a sectional view of the second painted surface after the touch up paint mixture has been polished and heat cured; and FIG. 9 is a flow chart depicting a process for performing the automotive scratch repair process according to the present invention.

DETAILED DESCRIPTION OF THE INVENTION

Figure 1:
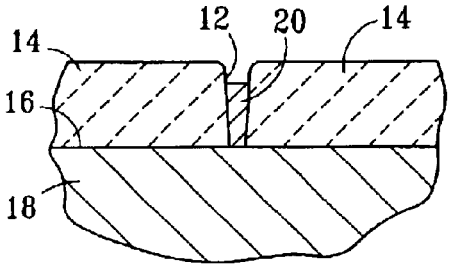
FIGS. 1 through 9 show various aspects for an automotive paint scratch repair process according to the present invention, as set forth below.
Figure 2:
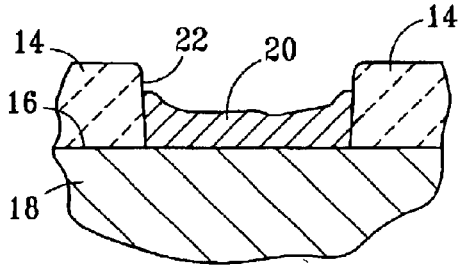

FIGS. 1 and 2 are sectional views a paint scratch 12 and a chip 22, respectively, which are void spaces formed into a paint 14 of a first painted surface 16. The scratch 12 is a void space which extends down to the surface 16 of base metal 18. Within the scratch 12 is a residue 20 of polish and other materials which normally collect on surfaces, such as the bodies of automobiles. Similarly, the chip 22 is a void space which extends down to the surface 16 of base metal 18. The residue 20 of polish and other materials which normally collect on surfaces, such as the bodies of automobiles, is also disposed in the chip 22 in the paint 14. The residue 20 is preferably removed from within the scratch 12 and the chip 22 in the paint 14 so that newly added paint will adhere directly to the surface 16 of the base metal 18 and that portion of the surface 24 of the original automotive paint 14 which is disposed within the crack 12 and the chip 22, respectively.

Figure 3:
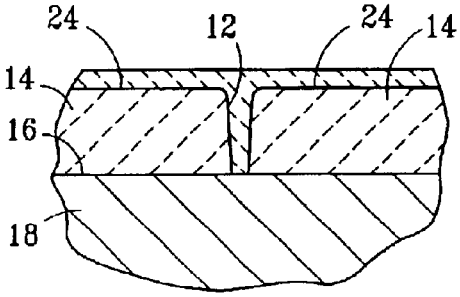
Figure 4:
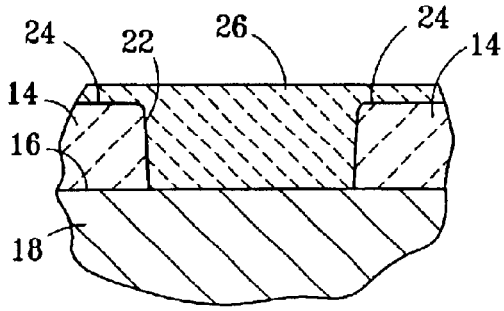

FIGS. 3 and 4 are sectional views of the paint scratch 16 and the chip 22, respectively, after a touch up paint mixture 26 has been applied to the first paint surface 24 and worked into the paint scratch 12 and the chip 22. Preferably, the residue 20 has been removed from within the scratch 12 and the chip 22 in the original paint 14. A touch up paint mixture 26 has been worked into the scratch 12 and the chip 22 in the original paint 14, and extends onto part of the outward portion of the surface 24 of the paint 14. Preferably, the touch up paint mixture 26 as shown in FIGS. 3 and 4 will partially cure, until it is dry to the touch, yet not fully cured, such that the touch up paint mixture 26 will adhere to the portion of the surface 24 of the paint within respective ones of the paint crack 12 and the paint chip 22, and to the exposed portion of the surface 16 of the base metal 18, if the residue shown in 20 has been removed from within respective ones of the crack 12 and the chip 22.

Figure 5:
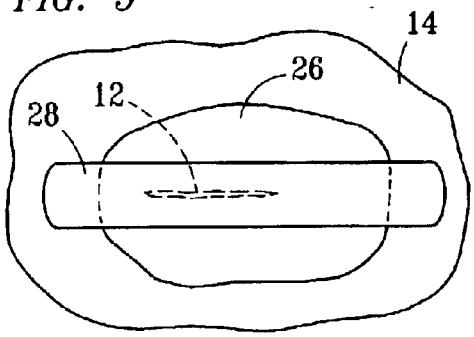
Figure 6:
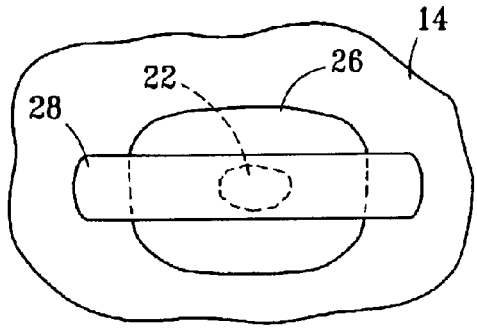

FIGS. 5 and 6 are top views of the paint scratch 12 and the paint chip 22 into the original paint 14 after the touch up paint 26 mixture has been applied and initially cured, and a polish 28 is applied to the paints 14 and 26, as seen looking downward onto FIGS. 3 and 4, respectively. As shown, the touch up paint mixture 26 is preferably applied to extend approximately one-half inch to three-quarters of an inch around the periphery of the scratch 12 or the chip 22. A bead of the polish 28 has been applied on top of the original paint 14 and the touch up paint 26. The polish 28 should be liberally applied to the outer surfaces of the original paint 14 and the touch up paint 26.

Figure 7:
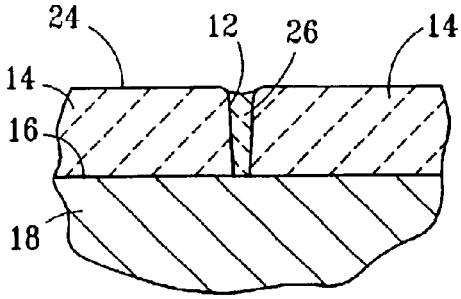
Figure 8:
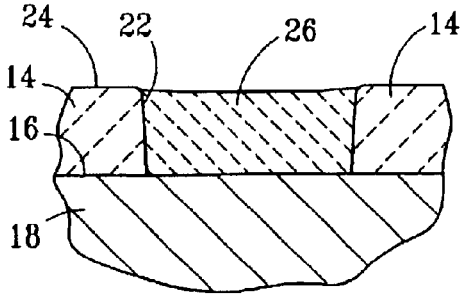

FIGS. 7 and 8 are sectional views of respective ones of the paint scratch 12 and the paint chip 22 after the touch up paint mixture 26 has been polished and heated cured. The touch up paint mixture 26 has been polished such that the outer surfaces of the paint mixture 26 adjacent to both the scratch 12 and the chip 22 are preferably slightly below flush with the outer portion of the surface 24 of the original paint 14. The touch up paint mixture 24 has preferably been removed from the outward portion of the surface 24 of the original paint 14.

Figure 9:
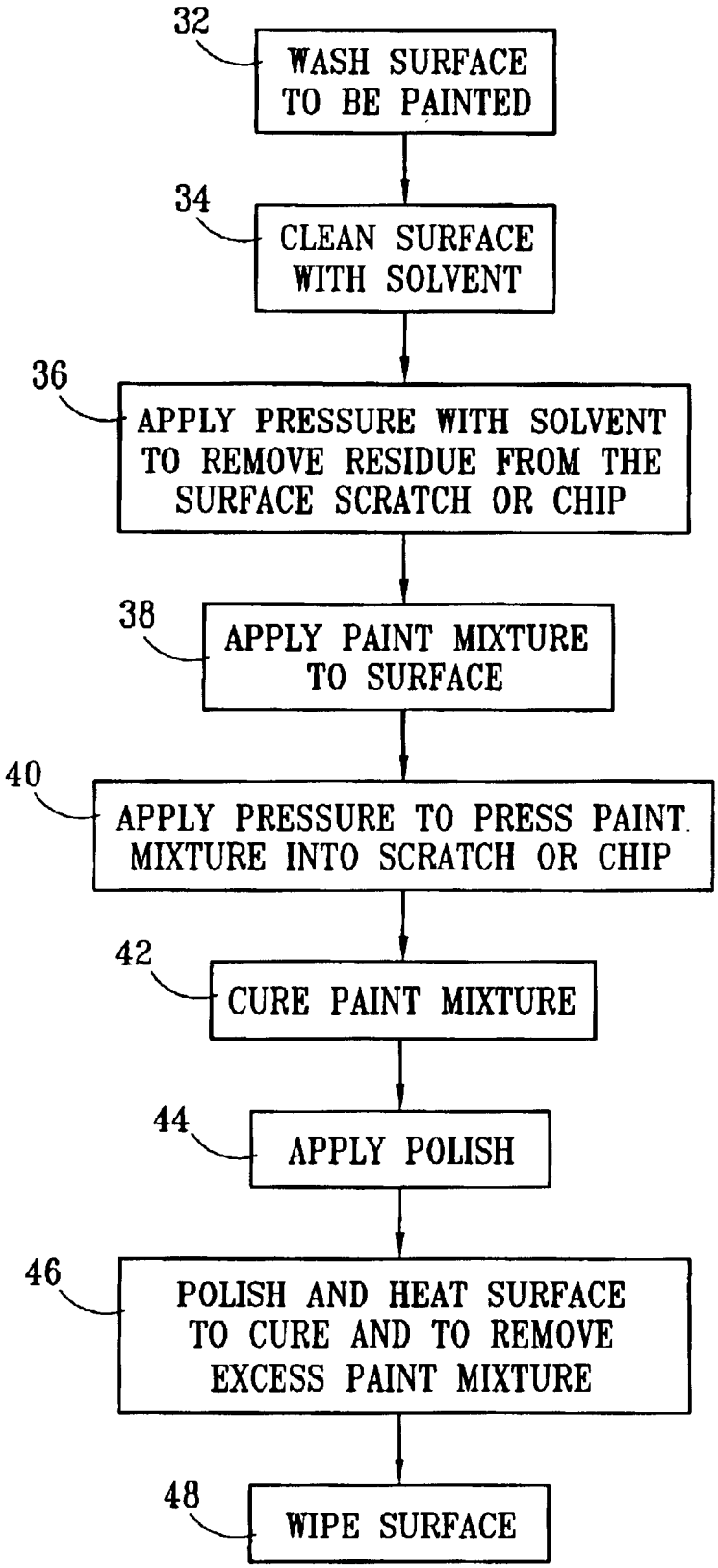

FIG. 9 is a flow chart depicting a process for performing the automotive scratch repair process according to the present invention. In the step depicted in block 32, the surface 24 to be touched up is washed to clean the paint surface 24 for the paint repair process, which provides a surface as shown in FIGS. 1 and 2. Then, in the step depicted in block 34, the paint surface 24 is cleaned with a solvent. The solvent is preferably provided by an automotive lacquer thinner, which typically contains toluene. In the step depicted in block 36, the solvent is rubbed into the paint surface 24 with a minimum pressure of two pounds per square inch, to clean the residue 20 from within the paint crack 20 or the chip 22.

In the step depicted in block 38, the touch up paint mixture 26 is applied to the surface 24 of the original paint 14. The touch up paint mixture 26 is preferably provided from commercially available automotive paint products. One mixture of suitable paint products is Sherman-Williams Series ULTRA 7000 automotive paint, available from The Sherwin-Williams Company, of Cleveland Ohio, in a mixture of three parts paint, one part clear coat, and one-thirty-second part of a paint flow additive. The paint flow additive prevents the touch up paint mixture 26 from pulling away from the scratch 12 and the chip 22, and is commonly referred to as a fishcye preventative. The paint is the Series ULTRA 7000 base paint. The clear coat is available as Refinisher's Select RS 6010. The paint flow additive, which is commonly called fisheye preventative, is available as FLAIR PFF 815. After the paint mixture 26 is provided, the mixture 26 is applied to the surface 24, as depicted in bock 38.

In the step depicted in block 40, pressure is applied to the paint mixture 26 to work the paint mixture 26 into the paint crack 12, or into the chip 22. Preferably, a minimum pressure of one and one-quarter pounds per square inch is applied directly to the touch up paint mixture 26 when disposed on the surface 24 of the paint 14 to work the paint mixture 26 into the paint crack 12 or the chip 22, and more preferably, a pressure of two to three pounds per square inch. In the preferred embodiment, the pressure to push the paint mixture 26 into the crack 12 or the chip 22 is provided by applying the paint to a cloth shop rag, and then rubbing the rag with the paint against the paint 14 and over the void space of the crack 12 or the chip 22 with sufficient force to provide the desired pressure to push the paint into the void space of the crack 12 or the chip 22. FIGS. 3 and 4 show the paint mixture 26 after it has been worked into respective ones of the crack 12 and the chip 22.

In the step depicted in block 42, the paint mixture 26 is allowed to partially cure, until it is dry to the touch. The following Table I lists cure time ranges for corresponding ambient temperature ranges for cure of the touch up paint mixture 26 after being applied to the original paint 14, until it is dry to the touch. The step of polishing and heating the paint mixture 26 should not begin until after the paint has cured for the minimum time, and should begin prior to the maximum time listed for the corresponding ambient temperature range to assure that the paint mixture 26 is properly cured during the polishing and heating step to remain in place, bonded within the crack 12 and the chip 22, and to assure that the paint mixture 26 may be removed from the outer portion of the surface 24 of the original paint 14.

TABLE I

| CURE TIME (minutes) | AMBIENT TEMPERATURE (° F.) |
|---|---|
| 1–2 | 85–110 |
| 2–3 | 75–85 |
| 3–4 | 65–75 |
| 4–5 | 55–65 |
| 5–6 | 45–55 |
| 6–7 | 35–45 |

In the step depicted in block 44, the polishing mixture 28 is applied to the outer surface of the touch up paint 26 and the outer portion of the surface 24 of the original paint 14, as shown in FIGS. 5 and 6. The polishing mixture 28 is preferably a mixture of various polishing compounds, which include aluminum silicate, bentonite clay, calcined alumina, dimethylkpolysiloxane, glycerine, kaolin clay, kerosene, mineral oil, mineral spirits, morpholine, petroleum naptha, polysiloxane, water, silicone, kerosene and petroleum solvent. In one embodiment, the polishing mixture 28 may be provided by combining several commercially available automotive polishing products, such as the waxes and cleaners, available from Malco Products, Inc., of Barberton, Ohio, in the following proportions, by volume: three parts of Part No. 1101; three parts of Part No. 1097; one part of Part No. 1045; and one part of Part No. 1202.

In the step depicted in block 46, the surface of the touch up paint 26 and the original paint 14 are polished and heated using a polishing pad. The polishing pad is preferably provided by a rotary polishing pad having a pile of natural wool fibers, the pile having yarn strands with first diameters of approximately one-eight inch, lengths of approximately one and one-half inches, and a density of approximately one hundred and twenty eight yarn strands per square inch. At the outer ends, the yarn strands flare out to approximately three-sixteenths inches to one-quarter inches in diameter. The yarn strands are arranged in a pattern of groups of yarn strands, with four fiber strands per group. The groups are arranged with four groups of four yarn strands per inch in one direction, and eight groups of four yarn strands per inch in a perpendicular directions, such that there are one hundred and twenty eight yarn strands per square inch. The rotary polishing pads are preferably seven and one-half inches in diameter, and available from K.E. Greer Distributing Company, of Fort Worth, Tex. The portion of the polishing pad which is approximately three and one-half inches from the center of the pad is preferably used as the point of contact of the polishing pad contacting the surfaces of the paint 14 and the touch up paint mixture 26 when the polishing pad is used on a rotary polisher at angular speeds of 800 to 1,000 rpm, which provides linear polishing speeds of 800 to 1050 feet per minute. The pad is preferably mounted to the rotary polisher with a velcro attachment, to reduce the risk of contact of the paint with a mounting bolt of the rotary polisher.

In the step shown in block 48, the outer portion of the surface 24 of the original paint 14 and the outer surface of the touch up paint mixture 26 are wiped clean, to remove dust and any debris left remaining from use of the polishing mixture 28 and removal of part of the paint mixture 26 in the polishing and heating step of block 46. The paint mixture 26 will then preferably appear as shown in FIGS. 7 and 8, with the outer surface slightly below flush with the outer portion of the surface 24 of the original paint 14.

The present invention provides several advantage over prior art paint touch-up processes. Rather than brushing or spraying paint onto the paint surfaces to be repaired, which usually results in the tough up paint not being placed inside of scratches and chips in painted surfaces, a liquid touch up paint mixture is pushed into scratches and chips. Then, after a short cure period, the touch up paint mixture is polished and heated by use of a polishing mixture and polishing pad operated in a speed range which provides the requisite amount of heat to cure the touch up paint mixture within the cracks and the chips, and to also polish excessive amounts of the touch up paint mixture from the surface of the original paint, without removal of excessive amounts of the touch up paint mixture from within the cracks and the chips. For automotive applications, the process of the present invention may often alleviate the requirement of repainting entire panels to touch up voids in automotive paints.

Although the preferred embodiment has been described in detail, it should be understood that various changes, substitutions and alterations can be made therein without departing from the spirit and scope of the invention as defined by the appended claims.

What is claimed is:

1. A paint repair process for touch up of a void space in a paint on painted surfaces, the paint repair process comprising the steps of:

cleaning a surface of the paint;

applying a paint mixture to the surface of the paint;

working the paint mixture into the void space in the paint, wherein pressure is applied directly to the paint mixture when disposed on the surface of the paint to force the paint mixture into the void space;

applying a polishing mixture to an outer surface of the paint mixture; and pressing a polishing surface against the outer surface of the paint mixture, with the polishing mixture disposed between the polishing surface and the outer surface of the paint mixture, and the polishing surface moving relative to the outer surface of the paint mixture at speed in a range from approximately 800 feet per minute to approximately 1050 feet per minute.

2. The paint repair process according to claim 1, wherein the step of working the paint mixture into the void space in the paint comprises the step of applying a minimum pressure of one and one-quarter pounds per square inch directly to the paint mixture when the paint mixture is disposed on the surface of the paint.

3. The paint repair process according to claim 2, wherein preferably the pressure applied in working the paint into the void space in the paint ranges from two and one-half to three pounds per square inch.

4. The paint repair process according to claim 3, wherein the step of pressing the polishing surface against the outer surface of the paint mixture further comprises pressing against the outer surface paint mixture with a maximum pressure of nine pounds per square inch.

5. The paint repair process according to claim 4, where in the polishing surface is pressing against the outer surface of the paint mixture with a pressure of six pounds per square inch.

6. The paint repair process according to claim 5, wherein the polishing surface is provided by a natural wool fiber, rotary, polishing pad.

7. The paint repair process according to claim 6, wherein the natural wool fiber, rotary polishing pad is provided by a pile of natural wool fibers, the pile having yarn strands being provided with first diameters of approximately one-eight inch, lengths of approximately one and one-half inches, and a density of approximately one hundred and twenty eight yarn strands per inch.

8. The paint repair process according to claim 1, further comprising the step of providing the paint mixture, which includes mixing a base coat paint, a paint clear coat and a paint flow additive together to provide the paint mixture.

9. The paint repair process according to claim 8, wherein the step of providing the paint mixture further includes mixing three parts of the base coat paint, one part of the paint clear coat, and one-thirty-second part of the paint flow additive, by volume.

10. A paint repair process for touch up of a void space in a paint on painted surfaces, the paint repair process comprising the steps of:

cleaning a surface of the paint;

applying a paint mixture to the surface of the paint;

working the paint mixture into the void space in the paint, wherein a minimum pressure of approximately one and one-quarter pounds per square inch is applied directly to the paint mixture when disposed on the surface of the paint to force the paint mixture into the void space;

applying a polishing mixture to an outer surface of the paint mixture; and pressing a polishing surface against the outer surface of the paint mixture with a minimum pressure of two pounds per square inch, with the polishing mixture disposed between the polishing surface and the outer surface of the paint mixture, and the polishing surface moving relative to the outer surface of the paint mixture at speed in a range from approximately 800 feet per minute to approximately 1050 feet per minute.

11. The paint repair process according to claim 10, wherein preferably the minimum pressure applied in working the paint into the void space in the paint ranges from two and one-half to three pounds per square inch.

12. The paint repair process according to claim 10, wherein the polishing surface is pressed against the outer surface of the paint mixture with a maximum pressure of nine pounds per square inch.

13. The paint repair process according to claim 10, wherein the polishing surface is pressed against the outer surface of the paint mixture with a pressure of approximately six pounds per square inch.

14. The paint repair process according to claim 10, wherein the polishing surface is provided by a natural wool fiber, rotary polishing pad, the rotary polishing pad having a pile of natural wool fibers, the pile having yarn strands being provided with first diameters of approximately one-eighth inch, lengths of approximately one and one-half inches, and a density of approximately one hundred and twenty eight yarn strands per inch.

15. The paint repair process according to claim 10, further comprising the step of providing the paint mixture, which includes mixing a base coat paint, a paint clear coat and a paint flow additive together to provide the paint mixture.

16. The paint repair process according to claim 15, wherein the step of providing the paint mixture further includes mixing three parts of the base coat paint, one part of the paint clear coat, and one-thirty-second part of the paint flow additive, by volume.

17. A paint repair process for touch up of a void space in a paint on painted surfaces, the paint repair process comprising the steps of:

cleaning a surface of the paint;

mixing a base coat paint, a paint clear coat and a flow additive together to provide a paint mixture;

applying the paint mixture to the surface of the paint;

working the paint mixture into the void space in the paint, wherein a minimum pressure of approximately one and one-quarter pounds per square inch is applied directly to the paint mixture when disposed on the surface of the paint to force the paint mixture into the void space;

applying a polishing mixture to an outer surface of the paint mixture;

providing a natural wool fiber polishing pad; and pressing the polishing pad against the outer surface of the paint mixture with a minimum pressure of two pounds per square inch, with the polishing mixture disposed between the polishing surface and the outer surface of the paint mixture, and the polishing surface moving relative to the outer surface of the paint mixture at speed in a range from approximately 800 feet per minute to approximately 1050 feet per minute.

18. The paint repair process according to claim 17, wherein preferably the pressure applied in working the paint into the void space in the paint ranges from two and one-half to three pounds per square inch.

19. The paint repair process according to claim 17, wherein the polishing pad is pressed against the outer surface of the paint mixture with a maximum pressure of nine pounds per square inch.

20. The paint repair process according to claim 19, wherein the polishing pad is pressed against the outer surface of the paint mixture with a pressure of approximately six pounds per square inch.

21. The paint repair process according to claim 17, wherein the step of providing the natural wool fiber polishing pad comprises providing a rotary polishing pad having a pile of natural wool fibers, the pile having yarn strands being provided with first diameters of approximately one-eight inch, lengths of approximately one and one-half inches, and a density of approximately one hundred and twenty eight yarn strands per inch.

22. The paint repair process according to claim 21, wherein the step of providing the paint mixture further includes mixing three parts of the base coat paint, one part of the paint clear coat and one-thirty-second part of the flow additive, by volume.

* * * * *